US005304298A

United States Patent [19]

Brenk

[11] Patent Number: 5,304,298

[45] Date of Patent: Apr. 19, 1994

[54] PROCESS FOR ROUGHENING ALUMINUM OR ALUMINUM ALLOYS

[75] Inventor: Michael Brenk, Wiesbaden, Fed. Rep. of Germany

[73] Assignee: Hoechst Aktiengesellschaft, Frankfurt am Main, Fed. Rep. of Germany

[21] Appl. No.: 937,680

[22] Filed: Sep. 1, 1992

[30] Foreign Application Priority Data

Sep. 9, 1991 [DE] Fed. Rep. of Germany ..... 4129909

[51] Int. Cl.[5] ..... C25F 1/02; C25F 3/04; C25D 11/08; C25D 11/24

[52] U.S. Cl. ..... 205/106; 205/201; 205/214; 204/129.1; 204/129.35; 204/129.4; 204/129.75; 204/DIG. 8

[58] Field of Search ..... 204/129.1, 129.4, 129.75, 204/DIG. 8, 129.35; 205/201, 106, 214

[56] References Cited

U.S. PATENT DOCUMENTS

| | | | |
|---|---|---|---|
| 3,193,485 | 7/1965 | Vincent | 204/141 |
| 3,632,486 | 1/1972 | Herrmann | 204/33 |
| 3,766,043 | 10/1973 | Herrmann et al. | 204/207 |
| 3,779,877 | 12/1973 | Alwitt | 204/129.75 |
| 3,887,447 | 6/1975 | Sheasby et al. | 204/129.4 |
| 3,929,591 | 12/1975 | Chu et al. | 204/17 |
| 3,963,594 | 6/1976 | Brasko | 204/129.95 |
| 3,980,539 | 9/1976 | Lloyd et al. | 204/129.75 |
| 4,052,275 | 10/1977 | Gumbinner et al. | 204/129.95 |
| 4,072,589 | 2/1978 | Golda et al. | 204/129.4 |
| 4,087,341 | 5/1978 | Takahashi et al. | 204/129.43 |
| 4,172,772 | 10/1979 | Ould et al. | 204/129.85 |
| 4,272,342 | 6/1981 | Oda et al. | 204/129.4 |
| 4,294,672 | 10/1981 | Ohba et al. | 204/129.4 |
| 4,301,229 | 11/1981 | Sakaki et al. | 430/158 |
| 4,437,955 | 3/1984 | Shaffer | 204/129.4 |
| 4,518,471 | 5/1985 | Arora | 204/129.1 |
| 4,525,249 | 6/1985 | Arora | 204/129.75 |
| 4,566,959 | 1/1986 | Mohr | 204/129.75 |
| 4,600,482 | 7/1986 | Mohr | 204/129.4 |
| 4,618,405 | 10/1986 | Mohr et al. | 204/129.75 |
| 4,661,219 | 4/1987 | Pliefke | 204/129.75 |
| 4,666,576 | 5/1987 | Pliefke | 204/129.75 |
| 4,721,552 | 1/1988 | Huang et al. | 204/129.4 |
| 4,786,381 | 11/1988 | Mohr et al. | 204/129.75 |
| 4,840,713 | 6/1989 | Pliefke | 204/129.75 |
| 5,041,198 | 8/1991 | Hausmann | 204/129.35 |
| 5,045,157 | 9/1991 | Nishino et al. | 204/33 |
| 5,141,605 | 8/1992 | Nishino et al. | 204/129.75 X |
| 5,156,723 | 10/1992 | Pliefke et al. | 204/129.75 |

FOREIGN PATENT DOCUMENTS

| | | |
|---|---|---|
| 0035730 | 9/1981 | European Pat. Off. . |
| 0036672 | 9/1981 | European Pat. Off. . |
| 0131926 | 1/1985 | European Pat. Off. . |
| 0422682 | 4/1991 | European Pat. Off. . |
| 3312496 | 10/1984 | Fed. Rep. of Germany . |
| 3503927 | 8/1986 | Fed. Rep. of Germany . |
| 3717654 | 12/1988 | Fed. Rep. of Germany . |
| 3836810 | 5/1989 | Fed. Rep. of Germany . |
| 53-91334 | 8/1978 | Japan . |
| 53-123204 | 10/1978 | Japan . |
| 57-16918 | 4/1982 | Japan . |
| 1051396 | 3/1986 | Japan . |
| 879768 | 10/1961 | United Kingdom . |
| 1400918 | 7/1975 | United Kingdom . |
| 2047274 | 11/1980 | United Kingdom . |
| 1582620 | 1/1981 | United Kingdom . |
| 2058136 | 4/1981 | United Kingdom . |
| 2060923 | 5/1981 | United Kingdom . |

OTHER PUBLICATIONS

Albrecht, *Westdeutscher Verlag, Cologne and Opladen*, "Determination of an Optimum Water Supply to Increase the Performance of Offset Printing", p. 7, 1966.

Decker, "Contribution on the Analyse.." p. 18, Dec. 1975.

Dowell, *Transactions of the Institute of Metal Finishing*, "The Altermating Current Etching of Aluminium Lithographic Sheet", pp. 138–144, 1979, vol. 57.

*Primary Examiner*—Donald R. Valentine

*Attorney, Agent, or Firm*—Foley & Lardner

[57] ABSTRACT

A process for roughening aluminum or aluminum alloys useful as support material for printing plates, in which process two electrochemical roughening steps are carried out in direct succession and are followed by a pickling step. Printing plates are produced from this support material by coating with light-sensitive coatings, which printing plates, when exposed and developed, give corresponding printing formes of very uniform topography, high run stability and good damping agent supply.

21 Claims, No Drawings

PROCESS FOR ROUGHENING ALUMINUM OR ALUMINUM ALLOYS

BACKGROUND OF THE INVENTION

1. Field of the Invention

The invention relates to a process for roughening aluminum or aluminum alloys as support material for printing plates, in which process two electrochemical roughening steps are carried out in direct succession. The invention also relates to a printing plate comprising a support material which is produced by the process.

2. Description of Related Art

Printing plates, in particular offset printing plates, generally comprise a support and at least one radiation-sensitive coating arranged thereon, said coating being applied to the coating support by the user in the case of non-precoated plates or by the manufacturer in the case of precoated plates.

Aluminum or one of its alloys have found acceptance as coating supports in the printing plate sector. In principle, these coating supports can be used without a modifying pretreatment, but in general they are modified in or on the surface, for example by a mechanical, chemical and/or electrochemical roughening, which is sometimes also termed graining or etching, a chemical or electrochemical oxidation and/or a treatment with agents which render the surface hydrophilic.

In modern continuous high-speed plants for the production of printing plate supports and/or precoated printing plates a combination of the said processing steps is frequently used, in particular a combination of electrochemical roughening and anodic oxidation, optionally with a subsequent step for rendering the surface hydrophilic.

The roughening can be carried out in aqueous acids, for example aqueous HCl or $HNO_3$ solutions, or in aqueous salt solutions, for example aqueous NaCl or $Al(NO_3)_3$ solutions, applying alternating current. The peak-to-valley heights of the roughened surface which are achievable in this way and which are given, for example, as average peak-to-valley heights $R_z$ are in the range from 1 to 15 μm, in particular in the range from 2 to 8 μm. The peak-to-valley height is determined in accordance with DIN 4768 in the October 1970 version. The arithmetic mean of the individual peak-to-valley heights of five adjacent individual measured sections is calculated as the average peak-to-valley height $R_z$.

The roughening is carried out, inter alia, in order to improve the adhesion of the reproduction coating to the coating support and of the damping agent supply to the printing form formed from the printing plate by exposure and development.

The water supply is an important quality characteristic for offset printing plates. It is defined in the publication "Ermittlung einer optimalen Wasserfuhrung zur Steigerung der Leistungsfahigkeit des Offsetdruckes" [Determination of an optimum water supply to increase the performance of offset printing] (Albrecht, J.; Rebner, W., Wirz, B., Westdeutscher Verlag, Cologne and Opladen 1966, page 7) as the metering and control of the damping of the printing form during the printing run. The water supply also depends, inter alia, on the surface roughness of the printing form, i.e., graining of the surface. The problems of inadequate water supply are adequately known: if too much water is required to keep non-printing parts of a printing form free from ink, more water is able to emulsify into the ink and the print becomes flat. Moreover, water marks can be produced, the paper becoming damp. In addition, register problems can arise and in the case of web-offset printing there is an increased risk of the paper web tearing. The above lists only a few of the problems. Comments on the significance of a correct water supply can also be found in the publication "Beitrag zur Analyse des Offsetprozesses" ("Contribution on the analysis of the offset process"), pages 17–18 (Deoker, P.; Polygraph Verlag, Frankfurt am Main). In this publication the consequences of too high and too low damping agents supply are discussed. This term is more appropriate than the term "water supply" in so far as, in offset printing, in general, pure water is not used for damping, but usually several components are added to the water.

In the cited publication, the disadvantages of an excessive damping agent supply, which have already been mentioned above, are listed. However, too low a supply of damping agent is also a disadvantage. If the printing plate in the printing machine is supplied with too little damping agent, as a result of too low a setting of the damping unit, or if the printing plate requires more damping agent than the damping unit of the printing machine is able to supply by reason of its construction or on other grounds, parts of the printing plate which otherwise are non-printing are also able to take up ink and co-print, fine raster areas being particularly sensitive to co-printing. The co-printing of non-image areas within the raster areas is known as "smearing in".

Thus, a worthwhile aim is a printing plate which requires only very little damping agent, in order to still keep fine rasters, but also large-area non-image areas, free from ink, but which, on the other hand, also shows a neutral reaction towards large amounts of damping agent and gives flawless prints even if the damping agent supply at times exceeds the norm as a result of plant-induced fluctuations.

It is true that the damping agent consumption of a printing plate can be determined objectively with sufficient accuracy, but this is not the case for the damping agent supply, since there are no objective methods of determination for some of the above-mentioned adverse phenomena, for example smearing in (Decker, P., in "Beitrag zur Analyse. . ." ["Contribution on the analyse. . ."], page 18). For this reason the damping agent supply to a printing plate is here assessed qualitatively, using the adjectives "very good", "good", "satisfactory", "adequate", "moderate", "poor" and "very poor". The conditions under which these adjectives form the basis for the assessment are described below in the context of the discussion of the examples.

A further quality characteristic of an offset printing plate is the brightness and the uniformity of the brightness of the support material. The brightness can, for example, be determined in the manner described in DIN Standard 6174 in the January 1979 version. This standard also indicates how the uniformity of the color print can be quantified. In this standard the value $\delta E_{ab^*}$, which can be calculated from the three colour values L*, a* and b*, is used as a measure for the uniformity. A support must not be too dark, so that not too much of the incident light is absorbed by the support surface itself and is thus lost to photochemical reactions in the actual light-sensitive coating. Similarly, the surface should be uniformly bright, so that the sensitivity to light does not vary from location to location on the printing plate.

By means of the exposure or irradiation and development or decoating in the case of process coatings which act electrophotographically, the image areas, which carry ink during subsequent printing, and the non-image areas, which carry damping agent and which generally are composed of the exposed support surface, are produced on the printing plate and by this means the actual printing form is formed. Very diverse parameters have an influence on the subsequent topography and thus on the damping agent supply on the surface to be roughened. For example, the following literature references provide information on this:

In the article "The Alternating Current Etching of Aluminum Lithographic Sheet" by A. J. Dowell in Transactions of the Institute of Metal Finishing, 1979, Vol. 57, pages 138 to 144, the fundamental principles of the roughening of aluminum in aqueous hydrochloric acid solutions are discussed, the following process parameters being varied and the corresponding effects are studied. In the case of repeated use of the electrolyte, the electrolyte composition is changed, for example in respect of the $H^+(H_3O^+)$ ion concentration, which can be determined via the pH value, and the $Al^{3+}$ion concentration, with observable effects on the surface topography. Temperature variation between 16° C. and 90° C. shows a modifying influence only above about 50° C., which is discernable, for example, in the substantial decline in coating formation on the surface. The roughening period, of between 2 and 25 min, also leads to an increasing dissolution of metal with increasing period of action. Variation in the current density between 2 and 8 $A/dm^2$ also results in higher roughness values with increasing current density. If the acid concentration is in the range of 0.5 and 2% HCl, only minor changes in the hole structure occur, below 0.5% HCl there is only a local attack at the surface and at high values an irregular dissolution of aluminum occurs. If pulsed direct current is used instead of alternating current, it is found that both half-wave types are apparently required for a uniform roughening. In this literature reference it is pointed out that the addition of sulfate ions increasingly leads to undesired, coarse, non-homogeneous roughening structures, which are not suitable for lithographic purposes.

The establishment of a flat and uniform surface topography is difficult in pure hydrochloric acid electrolytes and in this case it is necessary to keep the operating conditions within very narrow limits.

The influence of the composition of the electrolyte on the roughening quality is also described, for example, in the following publications:

DE-A 22 50 275 (=GB-A 1,400,918) names aqueous solutions containing 1.2 to 1.5% by weight of $HNO_3$ or 0 4 to 0.6% by weight of HCl and optionally 0.4 to 0.6% by weight of $H_3PC_4$ as electrolytes for the alternating current roughening of aluminum for printing plate supports, DE-A 28 10 308 (=U.S. Pat. No. 4,072,589) names aqueous solutions containing 0.2 to 1.0% by weight of HCl and 0.8 to 6.0% by weight of $HNO_3$ as electrolytes for the alternating current roughening of aluminum.

The purpose of additives to HCl electrolytes is to prevent adverse local attack in the form of deep holes. Thus, the following additions are described:

monocarboxylic acids, for example acetic acid, in DE-A 28 16 307 (=U.S. Pat. No. 4,172,772), gluconic acid, in U.S. Pat. No. 3,963,594, citric acid and malonic acid, in EP-A 0,036,672 and tartaric acid, in U.S. Pat. No. 4,052,275.

All of these organic electrolyte constituents have the disadvantage that they become electrochemically unstable and decompose at high current load, which is to be equated with high voltage load.

DE-A 35 03 927 describes ammonium chloride as an inorganic additive to a HCl electrolyte.

Inhibiting additives, as described as phosphoric acid or chromic acid in U.S. Pat. No. 3,887,447 and as boric acid in DE-A 25 35 142 (=U.S. Pat. No. 3,980,539), have the disadvantage that the protective effect frequently collapses locally and individual, particularly pronounced graining is able to form in the affected areas.

JP-A 91 334/78 discloses an alternating current roughening in an electrolyte composed of hydrochloric acid and an alkali metal halide for the production of a lithographic support material.

DE-A 16 21 115 (=U.S. Pat. No. 3,632,486 and U.S. Pat. No. 3,766,043) mentions a direct current roughening in dilute hydrofluoric acid, the aluminum strip being connected as the cathode.

Another known possibility for improving the uniformity is the modification of the type of current used. These include, for example, alternating current, with which the anode voltage and the anodic coulomb input are greater than the cathode voltage and the cathodic coulomb input (DE-A 26 50 762=U.S. Pat. No. 4,087,341), the anodic alternation time of the alternating current generally being set at less than the cathodic alternation time; reference is also made to this method, for example, in DE-A 29 12 060 (=U.S. Pat. No. 4,301,229), DE-A 30 12 135 (=GB-A 2,047,274) or DE-A 30 30 815 (=U.S. Pat. No. 4,272,342), alternating current, with which the anode voltage is clearly increased compared with the cathode voltage (DE-A 14 46 026 =U.S. Pat. No. 3,193,485), and interruption of the current flow for 10 to 120 s, and current flow for 30 to 300 s, alternating current and, as electrolyte, an aqueous 0.75 to 2 N HCl solution containing added NaCl or $MgCl_2$ being used (GB-A 879,768). A similar process with interruption of the current flow in the anode or cathode phase is also described in DE-A 30 20 420 (=U.S. Pat. No. 4,294,672).

The said methods give aluminum surfaces which, it is true, have a relatively uniform hole size distribution, but require relatively high expenditure on apparatus and can also be used only within very narrow parameter limits. Moreover, the supports can be produced with uniform brightness only with difficulty.

Another procedure disclosed in the patent literature is the combination of two roughening processes. Compared with the one-step process, this has the advantage that, depending on the process control, the influence of one or the other step can predominate within certain limits predetermined by the characteristics of the individual steps.

U.S. Pat. No. 3,929,591, GB-A 1,582,620, JP-A 123 204/78, DE-A 30 31 764 (=GB-A 2,058,136), DE-A 30 36 174 (=GB-A 2,060,923), EP-A 0,131,926, DE-A 30 12 135 (=GB-A 2,047,274) and JP-B 16 918/82 describe the combination of a prestructuring, carried out mechanically in the first step, followed by an optional chemical cleaning (pickling), with an electrochemical roughening by means of modified alternating current in electrolytes containing hydrochloric acid or nitric acid, it being possible for a further cleaning step then to take place.

These processes make use of the advantage of double roughening, with a mechanical roughening as the first step, as a result of which, in particular, a current saving is achieved.

DE-A 38 36 810 discloses a double roughening with two electrochemical roughening steps and an etching treatment which takes place between the two roughening steps.

Various two-step processes are known for the production of capacitors from aluminum foils. U.S. Pat. No. 4,525,249 describes a process which uses hydrochloric acid in the first step and in the second step treats the aluminum foil with a dilute nitric acid, which also contains aluminum in the form of aluminum nitrate, in the absence of current. This process does not yield surfaces which are able to meet the current stringent requirements in respect of offset printing plates.

Two-step processes which use electrochemical processes in both steps have also been disclosed. In the process according to U.S. Pat. No. 4,721,552, the first electrolyte contains hydrochloric acid while the second electrolyte can also contain hydrochloric acid in addition to nitric acid. A similar process is described in JP-A 86/051 396. These known processes do indeed give surfaces which are usable for lithographic purposes, but in respect of the fineness of the surface structure, these surfaces are inferior to those which are achieved in accordance with the teaching of DE-A 37 17 654.

U.S. Pat. No. 4,437,955discloses a two-step electrochemical roughening process for the production of capacitors using a hydrochloric acid-containing electrolyte in the first step and a chloride and sulfate ion-containing electrolyte in the second step. The electrolyte in the second step is not acid and in this step the process is carried out using direct current.

A further, two-step, electrochemical process for the production of a capacitor foil is described in U.S. Pat. No. 4,518,471. In this process the electrolytes in both baths are identical and contain dilute hydrochloric acid and aluminum ions. The baths are operated at different temperatures, specifically at 70° to 85° C. in the first step and at 75° to 90° C. in the second step.

The surfaces produced by the latter two processes, which have been optimized for electrolyte capacitors, are too pitted for use in lithography.

DE-A 38 36 810 describes a process in which aluminum is roughened, likewise in two steps, for the production of printing plate supports. In this process pickling is carried out between the first and the second roughening step. This process has the disadvantage that the plates develop an irregular surface and become very dark, especially if chloride-containing electrolytes are used in the final pickling step.

SUMMARY OF THE INVENTION

An object of the present invention is to improve a process for roughening aluminum for printing plate supports that, in addition to a uniformly bright, very fine, pit-free, surface-covering roughening structure of the aluminum surface of the printing plate supports, has very good reprographic and printing characteristics, in particular high print runs of the finished printing forms.

A further object of the present invention is to provide a process which permits targeted production of printing plate supports, the characteristics of which are controllable within wide ranges, and, without modifications to equipment, yields differently structured surfaces of the printing plate supports, in accordance with changing market demands.

A further object of the present invention is to provide an improved support which is useful, for example, as a support material for printing plates and to provide a process for producing such a printing plate.

In accomplishing the foregoing objectives, there has been provided, in accordance with one aspect of the present invention, a process for roughening an aluminum or aluminum alloy support material for printing plates comprising a) a first electrochemical roughening step carried out in an electrolyte containing an acid selected from the group consisting of hydrochloric, nitric, and sulfuric acid; and chloride or nitrate ions, b) a second electrochemical roughening step carried out in an electrolyte containing an acid selected from the group consisting of hydrochloric, nitric, and sulfuric acid; and chloride or nitrate ions, and c) a pickling step following the first and second electrochemical roughening steps.

In accordance with another aspect of the present invention, there is provided a roughened support produced by the above process having a surface brightness of from 60 to 90 and irregularities in the brightness of no more than $\delta Eab^* = 2$.

In accordance with another aspect of the present invention, there has been provided a printing plate comprising a light-sensitive coating coated on a support produced as described above.

In accordance with a further aspect of the invention, there has been provided a process for producing a printing plate comprising coating on a support roughened as described above a light sensitive material, drying the coated support material, exposing the dried material under an original, and developing the exposed material.

Further objects, features, and advantages of the present invention will become apparent from the detailed description of preferred embodiments which follows.

DETAILED DESCRIPTION OF THE PREFERRED EMBODIMENTS

The process of the present invention involves at least two electrochemical steps which both precede a pickling step. The second electrochemical roughening step of the present invention proceeds in an electrolyte in which the concentrations of the additives are the same as or different from those in the first roughening step. The roughening steps are preferably carried out in electrolytes containing nitric acid and aluminum chloride; nitric acid and aluminum nitrate; or sulfuric acid and aluminum chloride.

By means of the pickling step, undesirable layers, which make the surface non-uniform and dark, are removed from the surface of the support material.

In this context it has been found that the produced substrate has outstanding reprographic characteristics and good damping agent supply, accompanied by excellent print characteristics, such as a higher print run.

A surface produced by the process according to the invention is a highly uniform support surface having excellent lithographic characteristics. It has brightnesses which are variable within the range form $L=60$ to $L=90$, and irregularities in the brightness of no more than $\delta Eab^* = 2$. The values for the brightness and the non-uniformity were determined as described in DIN Standard 6174 in the January 1979 version.

The process can be carried out discontinuously or continuously with strips of aluminum or its alloys. In general, the process parameters in the continuous process are preferably within the following ranges during the roughening step: the temperature of electrolyte between 20° and 80° C., the current density between 3 and 180 A/dm$^2$, the dwell time in the electrolyte of a section of material to be roughened between 5 and 300 s and the electrolyte flow rate at the surface of the material to be roughened between 5 and 200 cm/s. As a consequence of the continuous procedure and the simultaneous release of Al ions and the consumption of $H^+$, continuous adjustment of the electrolyte composition by the corresponding dilute acids is needed in this case.

In the discontinuous process, the requisite current densities are preferably between 3 and 40 A/dm$^2$ and the dwell times are between 30 and 300 s. Electrolyte flow can also be dispensed with in this case.

In addition to sinusoidal alternating voltages of line frequency (50–60 Hz), superimposed alternating voltages and voltages of a frequency lower than the line frequency can also be employed during the roughening steps.

The materials to be roughened which are employed are, for example, the following, in the form of a plate, film or strip:

"Pure aluminum" (DIN material No. 3.0255), i.e., composed of more than 99.5% Al and the following permissible admixtures (to a total of 0.5% at most) of 0.3% Si, 0.4% Fe, 0.03% Ti, 0.02% Cu, 0.07% Zn and 0.03% others, or "Al alloy 3003" (comparable to DIN material No. 3.0515), i.e., composed of more than 98.5% Al, the alloying constituents 0 to 0.3% Mg and 0.8 to 1.5% Mn and the following permissible admixtures of 0.5% Si, 0.5% Fe, 0.2% Ti, 0.2% Zn, 0.1% Cu and 0.15% others.

The process can be used equally successfully on other aluminum alloys.

The roughening steps are followed by a pickling step, for example, by carrying out an anodic oxidation of the aluminum, by which means the abrasion and adhesion characteristics of the surface of the support material are improved. Any known method of pickling and anodic oxidation can be used.

The conventional electrolytes, such as sulfuric acid, phosphoric acid, oxalic acid, amidosulfonic acid, sulfosuccinic acid, sulfosalicylic acid or mixtures thereof, can be used for the anodic oxidation. Reference is made, for example, to the following standard methods for the anodic oxidation of aluminum (in this context see, for example, B. M. Schenk, Werkstoff Aluminium und seine anodische Oxidation [Aluminum material and its anodic oxidation], Francke Verlag, Berne 1948, page 760; Praktische Galvanotechnik [Practical electroplating], Eugen Leutze Verlag, Saulgau 1970 pages 395 et seq. and pages 518/519; W. Hubner and C. T. Speiser, Die Praxis der anodischen Oxidation des Aluminiums [The practice of anodic oxidation of aluminum], Aluminium Verlag, Dusseldorf 1977, 3rd Edition, pages 137 et seq.:

the direct current sulfuric acid process, in which anodic oxidation is carried out for 10 to 60 min in an aqueous electrolyte customarily composed of about 230 g $H_2SO_4$ per liter of solution at 10° to 22° C. and a current density of 0.5 to 2.5 A/dm$^2$. In this process the sulfuric acid concentration in the aqueous electrolyte solution can also be reduced down to 8 to 10% by weight of $H_2SO_4$ (about 100 g/l $H_2SO_4$) or raised to 30% by weight (365 g/l $H_2SC_4$) or more.

"Hard anodizing" is carried out using an aqueous electrolyte containing $H_2SO_4$ and having a concentration of 166 g/l $H_2SO_4$ (or about 230 g/l $H_2SO_4$) at an operating temperature of 0° to 5° C., at a current density of 2 to 3 A/dm$^2$, an increasing voltage, of about 25 to 30 V at the start and about 40 to 100 V towards the end of the treatment, and for 30 to 200 min.

In addition to the processes already mentioned in the preceding paragraph for the anodic oxidation of printing plate support materials, it is also possible to use, for example, the following processes: anodic oxidation of aluminum in an aqueous electrolyte which contains $H_2SO_4$ and $Al^{3+}$ the ion content of which is adjusted to values of more than 12 g/l, in an aqueous electrolyte containing $H_2SO_4$ and $H_3PO_4$ or in an aqueous electrolyte containing $H_2SO_4$, $H_3PO_4$ and $Al^{3+}$ ions.

Direct current is preferably used for anodic oxidation, but alternating current or a combination of these current types (for example direct current with superimposed alternating current) can also be used. The coating weights of aluminum oxide generally vary within the range from 1 to 10 g/m$^2$, corresponding to a coating thickness of about 0.3 to 3.9 μm.

A modifying treatment, which effects superficial denudation of the roughened surface, can also be employed following the electrochemical roughening and before an anodic oxidation. This treatment can be carried out either in acid or in alkali media.

As a result of the removal of fine structures, a modifying intermediate treatment of this type yields, inter alia, a uniformly bright surface, and the water supply to the plates over the surface is improved.

The anodic oxidation of the aluminum printing plate support material can be followed by one or more after-treatment steps. In this context after-treatment is understood to mean, in particular, a chemical or electrochemical treatment of the aluminum oxide coating in order to render it hydrophilic, for example a dip treatment of the material in an aqueous polyvinylphosphonic acid solution, a dip treatment in an aqueous alkali metal silicate solution or an electrochemical treatment (anodising) in an aqueous alkali metal silicate solution. These after-treatment steps serve, in particular, to further increase the hydrophilic character of the aluminum oxide coating, which is already adequate for many fields of application, without impairing the other known characteristics of this coating.

A support material produced by the process according to the invention is converted to a printing plate by coating with a light-sensitive coating.

Suitable light-sensitive process coatings are, in principle, all coatings which, after exposure and a subsequent development and/or fixing, yield an image-wise surface from which prints can be taken and/or which represent a relief image of an original. The process coatings are applied either by the manufacturer of presensitised printing plates or directly by the user to one of the conventional support materials.

Light-sensitive process coatings include those which are described, for example, in "Light-Sensitive Systems" by Jaromir Kosar, John Wiley & Sons, N. Y. 1965: the coatings containing unsaturated compounds, in which these compounds are isomerised, rearranged, cyclised or cross-linked on exposure (Kosar, Chapter 4), such as, for example, cinnamate; the coatings containing photopolymerisable compounds, in which monomers or prepolymers polymerise, where appropriate by means of an initiator, on exposure (Kosar, Chapter 5); and the o-diazo-quinones, such as naphthoquinone diazides, p-diazo-quinones or coatings containing diazonium salt condensation products (Kosar, Chapter 7).

Suitable coatings also include the electrophotographic coatings, i.e., those which contain an inorganic or organic photoconductor. In addition to the light-sensitive substances, these coatings can, of course, also contain other constituents, for example resins, dyes, pigments, wetting agents, sensitizers, adhesion promoters, indicators, plasticizers or other conventional auxiliaries.

Photo-semiconducting coatings, such as are described, for example, in DE-C 11 17 391, 15 22 497, 15 72 312, 23 22 046 and 23 22 047, can also be applied to the support materials, by which means highly light-sensitive, electrophotographic coatings are formed.

The materials for printing plate supports which have been roughened by the process according to the invention have a uniform brightness and a very uniform topography, which has a beneficial effect on the run stability and the damping agent supply when printing from printing formes produced from these supports. Undesirable "graining", which forms pronounced depressions compared with the surrounding roughening, occurs less frequently; this graining can even be completely suppressed.

The process according to the invention is described in more detail below with the aid of the examples indicated in the following tables and comparative examples.

An aluminum support material is first pickled for 60 s in an aqueous solution containing 20 g/l NaOH at room temperature. Roughening is carried out in the particular electrolyte systems indicated for roughening steps A, B, C and D by combination of two roughening steps, all possible combinations of the electrolyte systems for roughening steps A to D, including the combination of one of the roughening steps with itself, for example A—A, B—B, C—C or D—D, being possible in each case.

The assignment to the quality categories, taking into account the surface topography with respect to uniformity, freedom from graining and surface covering, is made by visual assessment under the microscope, a homogeneously roughened and pit-free surface being rated quality grade "10" (best value). A surface with thick grains more than 30 μm in size and/or an extremely non-uniformly roughened or virtually bright-rolled surface is rated as quality grade "0" (poorest value).

The brightness and the uniformity of the brightness of the support surface, which are indicated as L value and δE value in the following tables, are given as a further criterion for the quality. The higher the L value, the greater is the brightness and the higher the δE value the greater the variation in brightness from location to location on the support surface.

The following roughening steps A to D are used:

A electrochemical roughening in an electrolyte which contains 10 g/l HCl (calculated as 100% strength) and 65 g/l aluminum chloride ($AlCl_3.6H_2O$), at a temperature of 35° C., B electrochemical roughening in an electrolyte which contains 9 g/l nitric acid (calculated as 100% strength) and 67 g/l aluminum nitrate [$Al(NO_3)_3.9H_2O$], at a temperature of 40° C., C electrochemical roughening in an electrolyte which contains 28 g/l sulfuric acid and 100 g/l aluminum chloride ($AlCl_3.6H_2O$), at a temperature of 45° C., and D electrochemical roughening in an electrolyte which contains 25 g/l sulfuric acid and 130 g/l aluminum chloride ($AlCl_3.6H_2O$), at a temperature of 40° C.

Column 2 in the following tables shows the roughening process used in the first step, columns 3 and 4 the roughening time and the current density, column 5 shows the roughening process used in the second step, column 6 and 7 the roughening time and the current density, column 8 contains the L value explained above, which is a criterion for the brightness, column 9 contains the assignment of the support in quality categories, which has been explained in the previous section, and column 10 shows the uniformity δE of the brightness.

In each of the cases shown in Table 1, the supports are also subjected to alkaline pickling in a third step, following the two roughening steps. The pickling solution used in this case is an aqueous solution of 20 g/l NaOH and 2 g/l sodium carbonate (anhydrous) at room temperature of 20° to 24° C. The concentration both of the salt and of the acid can be varied. In this case, the temperature or the pickling time must then be adjusted if necessary. The pickling time is 15 s, but can be between 5 and 120 s. In no case should it be longer than 300 s in this pickling solution.

TABLE 1

| 1st Roughening Step | | | | 2nd Roughening step | | | | | |
|---|---|---|---|---|---|---|---|---|---|
| 1 No. | 2 Process | 3 Time s | 4 Current dens. A/dm² | 5 Process | 6 Time s | 7 Current dens. A/dm² | 8 Brightness L* | 9 Score | 10 δE |
| 1 | A | 20 | 100 | D | 15 | 40 | 65.5 | 7 | 0.4 |
| 2 | A | 20 | 100 | D | 20 | 40 | 69.2 | 7 | 0.3 |
| 3 | C | 10 | 40 | B | 15 | 40 | 71.4 | 10 | 0.3 |
| 4 | C | 10 | 40 | B | 20 | 40 | 80.0 | 10 | 0.6 |
| 5 | B | 30 | 60 | D | 10 | 40 | 83.4 | 7 | 0.8 |
| 6 | C | 30 | 60 | D | 15 | 60 | 81.2 | 6 | 0.8 |
| 7 | D | 8 | 35 | B | 20 | 40 | 78.6 | 9 | 0.7 |
| 8 | B | 15 | 80 | B | 25 | 40 | 69.8 | 8 | 0.8 |
| 9 | B | 30 | 40 | A | 25 | 90 | 75.8 | 8 | 0.9 |
| 10 | A | 20 | 100 | A | 10 | 60 | 77.6 | 7 | 1.2 |
| 11 | C | 20 | 100 | C | 13 | 60 | 74.1 | 7 | 0.9 |
| 12 | A | 20 | 100 | C | 17 | 60 | 72.4 | 7 | 0.8 |
| 13 | D | 30 | 60 | C | 10 | 40 | 77.3 | 7 | 0.5 |
| 14 | D | 30 | 60 | C | 15 | 40 | 78.3 | 7 | 0.6 |
| 15 | D | 30 | 60 | D | 40 | 90 | 79.4 | 6 | 0.8 |
| 16 | B | 30 | 60 | C | 10 | 80 | 75.6 | 7 | 1.1 |
| 17 | B | 30 | 60 | C | 10 | 40 | 73.5 | 7 | 0.8 |
| 18 | D | 30 | 60 | A | 15 | 80 | 75.1 | 8 | 0.5 |

TABLE 1-continued

| 1st Roughening Step | | | | 2nd Roughening step | | | | | |
|---|---|---|---|---|---|---|---|---|---|
| 1 No. | 2 Process | 3 Time s | 4 Current dens. A/dm² | 5 Process | 6 Time s | 7 Current dens. A/dm² | 8 Brightness L* | 9 Score | 10 δE |
| 19 | B | 30 | 60 | D | 10 | 40 | 81.4 | 7 | 0.8 |
| 20 | A | 30 | 80 | B | 15 | 40 | 82.1 | 8 | 1.1 |
| 21 | A | 10 | 80 | C | 10 | 40 | 81.1 | 7 | 0.9 |
| 22 | C | 30 | 60 | D | 15 | 60 | 81.3 | 6 | 0.8 |
| 23 | C | 10 | 40 | B | 15 | 40 | 79.6 | 10 | 0.4 |
| 24 | C | 10 | 40 | A | 20 | 40 | 71.6 | 10 | 0.5 |
| 25 | C | 10 | 40 | A | 10 | 60 | 72.0 | 8 | 0.6 |

Table 2 contains comparative examples of supports which were not produced by the process according to the invention. Except for the pickling step following the two roughening steps, the supports were produced under identical conditions to the supports in Table 1. Instead of the pickling step following the two roughening steps, a pickling step was inserted between the two roughening steps. This pickling step, which is not shown in Table 2, is an alkaline pickling. The pickling solution used in this case was an aqueous solution of 20 g/l NaOH and 2 g/l sodium carbonate (anhydrous) at room temperature of 20° to 24° C. The dip time was uniformly 30 s. The relatively poor quality of the supports can be seen from Table 2, compared with Table 1. The supports are darker than those produced according to the invention and the brightness is more irregular.

TABLE 2

| 1st Roughening Step | | | | 2nd Roughening step | | | | | |
|---|---|---|---|---|---|---|---|---|---|
| 1 No. | 2 Process | 3 Time s | 4 Current dens. A/dm² | 5 Process | 6 Time s | 7 Current dens. A/dm² | 8 Brightness L* | 9 Score | 10 δE |
| V1 | A | 20 | 100 | D | 15 | 40 | 59.5 | 6 | 3.4 |
| V2 | A | 20 | 100 | D | 20 | 40 | 59.2 | 5 | 2.3 |
| V3 | C | 10 | 40 | B | 15 | 40 | 59.5 | 4 | 2.3 |
| V4 | C | 10 | 40 | B | 20 | 40 | 60.0 | 5 | 6.6 |
| V5 | B | 30 | 60 | D | 10 | 40 | 59.9 | 6 | 3.1 |
| V6 | C | 30 | 60 | D | 15 | 60 | 50.2 | 4 | 3.8 |
| V7 | D | 8 | 35 | B | 20 | 40 | 59.4 | 4 | 6.7 |
| V8 | B | 15 | 80 | B | 25 | 40 | 59.8 | 3 | 4.8 |
| V9 | B | 30 | 40 | A | 25 | 90 | 55.6 | 6 | 2.9 |
| V10 | A | 20 | 100 | A | 10 | 60 | 55.6 | 4 | 2.2 |
| V11 | C | 20 | 100 | C | 13 | 60 | 54.1 | 5 | 2.9 |
| V12 | A | 20 | 100 | C | 17 | 60 | 52.4 | 6 | 4.8 |
| V13 | D | 30 | 60 | C | 10 | 40 | 57.3 | 6 | 15.5 |
| V14 | D | 30 | 60 | C | 15 | 40 | 58.3 | 7 | 0.6 |
| V15 | D | 30 | 60 | D | 40 | 90 | 59.4 | 5 | 6.8 |
| V16 | B | 30 | 60 | C | 10 | 80 | 55.6 | 4 | 5.1 |
| V17 | B | 30 | 60 | C | 10 | 40 | 55.6 | 4 | 6.8 |
| V18 | D | 30 | 60 | A | 15 | 80 | 55.1 | 4 | 5.5 |
| V19 | B | 30 | 60 | D | 10 | 40 | 51.4 | 7 | 2.8 |
| V20 | A | 30 | 80 | B | 15 | 40 | 52.1 | 6 | 2.1 |
| V21 | A | 10 | 80 | C | 10 | 40 | 53.1 | 6 | 5.9 |
| V22 | C | 30 | 60 | D | 15 | 60 | 51.3 | 4 | 5.8 |
| V23 | C | 10 | 40 | B | 15 | 40 | 69.6 | 7 | 4.4 |
| V24 | C | 10 | 40 | A | 20 | 40 | 61.6 | 6 | 5.5 |
| V25 | C | 10 | 40 | A | 10 | 60 | 62.0 | 6 | 6.6 |

Table 3 again contains comparative examples, which were not produced by the process according to the invention. In this case pickling was not carried out, either between the two roughening steps or after the roughening steps. The supports are overall even more non-uniform than the comparative examples from Table 2, in which the supports were pickled after the first roughening step.

TABLE 3

| 1st Roughening Step | | | | 2nd Roughening step | | | | | |
|---|---|---|---|---|---|---|---|---|---|
| 1 No. | 2 Process | 3 Time s | 4 Current dens. A/dm² | 5 Process | 6 Time s | 7 Current dens. A/dm² | 8 Brightness L* | 9 Score | 10 δE |
| V26 | A | 20 | 100 | D | 15 | 40 | 58.5 | 6 | 3.0 |
| V27 | A | 20 | 100 | D | 20 | 40 | 58.2 | 5 | 3.3 |
| V28 | C | 10 | 40 | B | 15 | 40 | 57.4 | 4 | 3.3 |
| V29 | C | 10 | 40 | B | 20 | 40 | 58.0 | 5 | 7.7 |
| V30 | B | 30 | 60 | D | 10 | 40 | 59.4 | 6 | 4.1 |
| V31 | C | 30 | 60 | D | 15 | 60 | 50.2 | 4 | 4.1 |
| V32 | D | 8 | 35 | B | 20 | 40 | 58.5 | 4 | 6.7 |
| V33 | B | 15 | 80 | B | 25 | 40 | 59.8 | 3 | 4.8 |
| V34 | B | 30 | 40 | A | 25 | 90 | 54.6 | 6 | 4.9 |
| V35 | A | 20 | 100 | A | 10 | 60 | 55.6 | 4 | 4.2 |
| V36 | C | 20 | 100 | C | 13 | 60 | 53.1 | 5 | 2.9 |
| V37 | A | 20 | 100 | C | 17 | 60 | 52.4 | 6 | 4.8 |
| V38 | D | 30 | 60 | C | 10 | 40 | 56.3 | 6 | 15.5 |

TABLE 3-continued

| 1st Roughening Step | | | | 2nd Roughening step | | | | | |
|---|---|---|---|---|---|---|---|---|---|
| 1 No. | 2 Process | 3 Time s | 4 Current dens. A/dm² | 5 Process | 6 Time s | 7 Current dens. A/dm² | 8 Brightness L* | 9 Score | 10 δE |
| V39 | D | 30 | 60 | C | 15 | 40 | 58.3 | 7 | 3.6 |
| V40 | D | 30 | 60 | D | 40 | 90 | 56.4 | 5 | 6.8 |
| V41 | B | 30 | 60 | C | 10 | 80 | 54.6 | 4 | 5.1 |
| V42 | B | 30 | 60 | C | 10 | 40 | 55.2 | 4 | 7.8 |
| V43 | D | 30 | 60 | A | 15 | 80 | 54.1 | 4 | 6.5 |
| V44 | B | 30 | 60 | D | 10 | 40 | 51.1 | 7 | 3.8 |
| V45 | A | 30 | 80 | B | 15 | 40 | 52.1 | 6 | 2.7 |
| V46 | A | 10 | 80 | C | 10 | 40 | 54.4 | 6 | 6.5 |
| V47 | C | 30 | 60 | D | 15 | 60 | 50.3 | 4 | 5.9 |
| V48 | C | 10 | 40 | B | 15 | 40 | 69.4 | 7 | 4.4 |
| V49 | C | 10 | 40 | A | 20 | 40 | 61.2 | 6 | 5.3 |
| V50 | C | 10 | 40 | A | 10 | 60 | 61.5 | 6 | 6.7 |
| V51 | A | 20 | 50 | — | — | — | 59.8 | 5 | 2.3 |
| V52 | B | 20 | 80 | — | — | — | 57.6 | 6 | 3.0 |
| V53 | C | 10 | 100 | — | — | — | 62.3 | 7 | 2.5 |
| V54 | D | 10 | 90 | — | — | — | 62.4 | 7 | 2.2 |

Examples V51 to V54 in the above table are supports which were subjected to roughening in only one step.

Table 4 shows the results for supports which were roughened in the same way as the supports in Table 1. They differ from those described in Table 1 in respect of the pickling. In each of the cases shown in Table 4 the supports are subjected to acid pickling in a third processing step following the two roughening steps. The pickling solution used in this case is an aqueous solution of 100 g/l $H_2SO_4$ and 5 g/l aluminum sulfate (anhydrous) at 45° C. These concentrations can be varied. The acid concentration can be in the range from 10 g/l to 500 g/l and the aluminum concentration can also be changed. At low acid concentrations it is advisable to raise the temperature. The pickling time is 60 s, but can be between 10 and 300 s. In no case should it be longer than 500 s in this pickling solution.

TABLE 4

| 1st Roughening Step | | | | 2nd Roughening step | | | | | |
|---|---|---|---|---|---|---|---|---|---|
| 1 No. | 2 Process | 3 Time s | 4 Current dens. A/dm² | 5 Process | 6 Time s | 7 Current dens. A/dm² | 8 Brightness L* | 9 Score | 10 δE |
| 26 | A | 20 | 100 | D | 15 | 40 | 64.5 | 7 | 0.6 |
| 27 | A | 20 | 100 | D | 20 | 40 | 68.2 | 7 | 0.4 |
| 28 | C | 10 | 40 | B | 15 | 40 | 69.8 | 10 | 0.8 |
| 29 | C | 10 | 40 | B | 20 | 40 | 79.5 | 10 | 0.9 |
| 30 | B | 30 | 60 | D | 10 | 40 | 83.0 | 7 | 0.7 |
| 31 | C | 30 | 60 | D | 15 | 60 | 81.0 | 6 | 1.9 |
| 32 | D | 8 | 35 | B | 20 | 40 | 78.2 | 9 | 1.4 |
| 33 | B | 15 | 80 | B | 25 | 40 | 69.2 | 8 | 0.9 |
| 34 | B | 30 | 40 | A | 25 | 90 | 75.1 | 8 | 0.9 |
| 35 | A | 20 | 100 | A | 10 | 60 | 76.6 | 7 | 1.3 |
| 36 | C | 20 | 100 | C | 13 | 60 | 73.1 | 7 | 1.1 |
| 37 | A | 20 | 100 | C | 17 | 60 | 72.0 | 7 | 1.8 |
| 38 | D | 30 | 60 | C | 10 | 40 | 77.2 | 7 | 0.7 |
| 39 | D | 30 | 60 | C | 15 | 40 | 78.1 | 7 | 0.7 |
| 40 | D | 30 | 60 | D | 40 | 90 | 79.1 | 6 | 0.9 |
| 41 | B | 30 | 60 | C | 10 | 80 | 75.6 | 7 | 1.5 |
| 42 | B | 30 | 60 | C | 10 | 40 | 72.4 | 7 | 0.9 |
| 43 | D | 30 | 60 | A | 15 | 80 | 74.0 | 8 | 0.8 |
| 44 | B | 30 | 60 | D | 10 | 40 | 80.1 | 7 | 0.9 |
| 45 | A | 30 | 80 | B | 15 | 40 | 81.8 | 8 | 1.5 |
| 46 | A | 10 | 80 | C | 10 | 40 | 81.0 | 7 | 1.2 |
| 47 | C | 30 | 60 | D | 15 | 60 | 80.3 | 6 | 1.2 |
| 48 | C | 10 | 40 | B | 15 | 40 | 77.6 | 10 | 0.8 |
| 49 | C | 10 | 40 | A | 20 | 40 | 68.6 | 10 | 0.7 |
| 50 | C | 10 | 40 | A | 10 | 60 | 71.0 | 8 | 0.8 |

Some of the plates produced in this way were selected for further tests. The plates were coated with a solution which has the following composition (pwt = parts by weight, pvol = parts by volume):

| | |
|---|---|
| 6.6 pwt of | cresol-formaldehyde novolak having a softening range of 105 to 120° C. in accordance with DIN 53 181, |
| 1.1 pwt of | 4-(2-phenyl-prop-2-yl)-phenyl 1,2-naphthoquinone-2-diazido-4-sulfonate, |
| 0.6 pwt of | 2,2'-bis-(1,2-naphthoqinone-2-diazido-5-sulfonyloxy)-1,1-dinaphthyl-methane, |
| 0.24 pwt of | 1,2-naphthoquinone-2-diazido-4-sulfonyl chloride, |
| 0.08 pwt of | crystal violet, and |
| 91.36 pwt of | a solvent mixture composed of 4 pvol of ethylene glycol monomethyl ether, 5 pvol of tetrahydrofuran and 1 pvol of butyl acetate. |

The coated supports are dried in a drying channel at temperatures of up to 120° C. The printing plates produced in this way are exposed under a positive original and developed using a developer of the following composition:

| | |
|---|---|
| 5.3 pwt of | sodium metasilicate.$9H_2O$ |
| 3.4 pwt of | trisodium phosphate |
| 0.3 pwt of | sodium dihydrogen phosphate (anhydrous) and |
| 91.0 pwt of | water. |

The developed plates were used for printing and the plates were tested with regard to print run and damping agent supply. It was found that these characteristics can be influenced in the desired manner by the pickling following the two roughening steps and are good without exception. Table 5 shows the selected supports with their numbers in Tables 1 to 4 and the results of the tests. One of the results is the quality of the water supply. It can be quantified only with difficulty, as previously described. For this reason, the following assessments have been made in Table 5:

| | |
|---|---|
| Very poor | The amount of damping agent must be kept within a very narrow sub-range of the total adjustment range for damping agent metering and the printing plate requires more than 100 sheets to run freely. |
| Poor | The amount of damping agent must be kept within of narrow sub-range of the total adjustment range for damping agent metering and requires 50–100 sheets to run freely. |
| Adequate | The amount of damping agent can be operated within a range of 20% of the possible damping agent metering range without it damaging the quality of the print and has run free after less than 50 sheets. |
| Satisfactory | The amount of damping agent can be operated within a range of 25% of the possible damping agent metering range without it damaging the quality of the print and has run free after less than 30 sheets. |
| Good | The amount of damping agent can be operated within a range of 25% of the possible damping agent metering range without damaging the quality of the print and has run free after less than 20 sheets. |
| Very good | The amount of damping agent can be operated within a range of 25% of the possible damping agent metering range without damaging the quality of the print and has run free after less than 15 sheets. |

TABLE 5

| Support | Run | Water Supply |
|---|---|---|
| 1 | 170,000 | good |
| 3 | 180,000 | very good |
| 9 | 150,000 | very good |
| 17 | 330,000 | very good |
| 24 | 190,000 | satisfactory |
| 28 | 130,000 | very good |
| 48 | 145,000 | good |

Table 6 shows the results for a few printing formes which were produced from supports not according to the invention and which are inferior to the printing formes of Table 5, either in respect of the print run or in respect of the water supply.

TABLE 6

| Support | Run | Water Supply |
|---|---|---|
| V1 | 80,000 | satisfactory |
| V5 | 60,000 | poor |
| V31 | 150,000 | very poor |
| V21 | 30,000 | good |
| V33 | 90,000 | poor |
| V38 | 30,000 | poor |
| V48 | 145,000 | poor |
| V51 | 120,000 | poor |
| V52 | 140,000 | very poor |
| V53 | 80,000 | satisfactory |
| V54 | 60,000 | satisfactory |

What is claimed is:

1. A process for roughening an aluminum or aluminum alloy support material useful for printing plates comprising a) a first electrochemical roughening step carried out in an electrolyte containing an acid selected from the group consisting of hydrochloric, nitric, and sulfuric acid; and chloride or nitrate ions, b) a second electrochemical roughening step following step a) carried out in an electrolyte containing an acid selected from the group consisting of hydrochloric, nitric, and sulfuric acid; and chloride or nitrate ions, and in which the concentrations of the additives are the same as or different from those in the first electrochemical roughening step, and c) a purely chemical pickling step in an acid or alkaline bath following step b), which removes undesirable layers which make the surface of the support non-uniform and dark.

2. A process as claimed in claim 1, wherein steps a) and b) comprise the same or different roughening steps selected from the group of roughening steps A, B, and C, wherein the roughening step A is carried out in an electrolyte which contains hydrochloric acid and aluminum chloride, B is carried out in an electrolyte which contains nitric acid and aluminum nitrate, and C is carried out in an electrolyte which contains sulfuric acid and aluminum chloride.

3. A process as claimed in claim 2, wherein the electrochemical roughening steps a) and b) are carried out continuously and, during each of the roughening steps A, B, and C, the temperature of the electrolyte is between 20° and 80° c., the current density if between 3 and 180 A/dm$^2$, the dwell time in the electrolyte of a support material section to be roughened is 5 to 300 s, and the electrolyte flow rate at the surface of the support material is 5 to 200 cm/s.

4. A process as claimed in claim 2, wherein the electrochemical roughening steps a) and b) are carried out discontinuously and, during each of the roughening steps A, B, and C, the temperature of the electrolyte is between 20° and 80° C., the current density is between 3 and 40 A/dm$^2$ and the dwell time in the electrolyte of a support material section to be roughened is 30 and 300 s.

5. A process as claimed in claim 2, wherein during each of the roughening steps A, B, and C, sinusoidal alternating voltages of mains frequency or superimposed alternating voltages of a frequency lower than the mains frequency are applied to the electrolyte baths containing the electrolyte and support materials to be roughened.

6. A process as claimed in claim 3, wherein the electrolyte composition is kept constant during steps a) and b) by continuous addition of the correspondingly diluted acids in the electrolytes during the individual roughening steps.

7. A process as claimed in claim 2, wherein step a) or b) or both comprise roughening step a wherein roughening step A is carried out in an electrolyte which contains 10 g/l HCl and 65 g/l $AlCl_3.6H_2O$, at a temperature of 35° C., for a dwell time of 10 to 30 s and at a current density of 40 to 100 A/dm$^2$.

8. A process as claimed in claim 2, wherein steps a) or b) or both comprise roughening step B, wherein a roughening step B is carried out in an electrolyte which contains 9 g/l nitric acid and 67 g/l of $Al(NO_3)_3.9H_2O$, at a temperature of 40° C., for a dwell time of 15 to 30 s and at a current density of 40 to 80 A/dm$^2$.

9. A process as claimed in claim 2, wherein steps a) or b) or both comprise roughening step C, wherein roughening step C is carried out in an electrolyte which contains 28 g/l sulfuric acid and 100 g/l $AlCl_3.6H_2O$, at a temperature of 45° C., for a dwell time of lo to 30 s and at a current density of 40 to 100 A/dm$^2$.

10. A process as claimed in claim 2, wherein steps a) or b) or both comprise roughening step C, wherein roughening step C is carried out in an electrolyte which contains 25 g/l sulfuric acid and 130 g/l $AlCl_3.6H_2O$, at a temperature of 40° C., for a dwell time of 8 to 40 s, and at a current density of 35 to 90 A/dm$^2$.

11. A process as claimed in claim 2, wherein steps a) and b) are the same or different roughening steps selected from the group consisting of said roughening steps A or B.

12. A process as claimed in claim 1, wherein the purely chemical pickling comprises pickling in an electrolyte which contains at least one of sulfuric acid, phosphoric acid, oxalic acid, amidosulfonic acid, sulfosuccinic acid, and sulfosalicylic acid.

13. A process as claimed in claim 1, wherein step c) comprises pickling in a pickling solution of an aqueous acid solution of 10 to 500 g/l $H_2SO_4$ and 3 to 20 g/l anhydrous aluminum sulfate for a pickling time of 10 to 300 s at a temperature of 45° C.

14. A process as claimed in claim 12, wherein the pickling solution is an aqueous acid solution of 100 g/l $H_2SO_4$ and 5 g/l anhydrous aluminum sulfate and wherein the pickling time is 60 s at a temperature of 45° C.

15. A process as claimed in claim 1, wherein step c) comprises pickling in a pickling solution of an aqueous alkali solution of 10 to 100 g/l NaOH and 2 g/l anhydrous sodium carbonate for a pickling time of 5 to 120 s at a room temperature of 20° to 24° C.

16. A process as claimed in claim 15, wherein the pickling solution is an aqueous solution of 20 g/l NaOH and 2 g/l anhydrous sodium carbonate and wherein the pickling time is 15 s at a room temperature of 20° to 24° C.

17. A process as claimed in claim 1, further comprising a step of anodic oxidation of the roughened support material, wherein the anodic oxidation is carried out using direct current or alternating current or using a combination of direct current with superimposed alternating current.

18. A process as claimed in claim 16, wherein the anodic oxidation results in coating weights of 1 to 10 g/m$^2$ of aluminum oxide on the roughened surface, corresponding to a coating thickness of about 0.3 to 3.9 μm, and wherein the anodic oxidation is followed by one or more steps for hydrophilising comprising treatment of the aluminum oxide coating by dip treatment in an aqueous polyvinylphosphonic acid solution or an aqueous alkali metal silicate solution or anodizing in an aqueous alkali metal silicate solution.

19. A process as claimed in claim 1, wherein the roughening steps a) and b) and the pickling step c) result in a surface brightness L of from 60 to 90 and irregularities in the brightness of the support material of no more than $\delta Eab^* = 2$.

20. A process as claimed in claim 1, wherein the support material is additionally subjected to a pickling step before step a).

21. A process as claimed in claim 1, wherein a pickling step is not carried out between steps a) and b).

* * * * *